US010890370B2

(12) United States Patent
Cetinyol et al.

(10) Patent No.: US 10,890,370 B2
(45) Date of Patent: Jan. 12, 2021

(54) COOLING DEVICE HAVING AN AIR CHANNEL AND A BAFFLE

(71) Applicant: BSH HAUSGERAETE GMBH, Munich (DE)

(72) Inventors: Dogukan Cetinyol, Istanbul (TR); Bilal Cinici, Tekirdag (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 486 days.

(21) Appl. No.: 15/512,847

(22) PCT Filed: Dec. 22, 2015

(86) PCT No.: PCT/EP2015/080906
§ 371 (c)(1),
(2) Date: Mar. 21, 2017

(87) PCT Pub. No.: WO2016/107784
PCT Pub. Date: Jul. 7, 2016

(65) Prior Publication Data

US 2017/0292765 A1 Oct. 12, 2017

(30) Foreign Application Priority Data

Dec. 31, 2014 (TR) ..... a 2014 16332

(51) Int. Cl.
*F25D 17/06* (2006.01)
*F25D 23/02* (2006.01)

(52) U.S. Cl.
CPC ..... *F25D 17/062* (2013.01); *F25D 17/06* (2013.01); *F25D 23/02* (2013.01); *F25D 2317/062* (2013.01); *F25D 2317/063* (2013.01)

(58) Field of Classification Search
CPC .. F25D 17/062; F25D 23/02; F25D 2317/062; F25D 2317/063
USPC ..... 454/183
See application file for complete search history.

(56) References Cited

U.S. PATENT DOCUMENTS

| | | | | |
|---|---|---|---|---|
| 2,794,325 A | | 6/1957 | Shearer | |
| 3,084,519 A | | 4/1963 | Hanson et al. | |
| 3,366,432 A | * | 1/1968 | Carmer | F25D 17/06 312/236 |
| 4,334,899 A | * | 6/1982 | McConnell | F24F 13/28 55/321 |
| 5,447,470 A | * | 9/1995 | Zaniewski | F24F 11/75 454/259 |

(Continued)

FOREIGN PATENT DOCUMENTS

| | | | |
|---|---|---|---|
| DE | 10139835 | A1 | 2/2003 |
| EP | 0031311 | A2 | 7/1981 |
| WO | 2008135434 | A2 | 11/2008 |

*Primary Examiner* — Steven B McAllister
*Assistant Examiner* — Allen R Schult
(74) *Attorney, Agent, or Firm* — Laurence A. Greenberg; Werner H. Stemer; Ralph E. Locher

(57) ABSTRACT

A cooling device, particularly a domestic refrigerator, includes a storage space defined by a body and by a door. An air channel is formed within a space that is at least partially filled with insulating or isolation material between an inner wall of the storage space and an outer wall of the cooling device. At least one opening is provided in the inner wall and is open to the air channel. A baffle is positioned completely within the air channel.

15 Claims, 8 Drawing Sheets

(56) References Cited

U.S. PATENT DOCUMENTS

| | | | | | |
|---|---|---|---|---|---|
| 5,495,726 | A * | 3/1996 | Lee | F25D 17/065 | 62/413 |
| 5,976,009 | A * | 11/1999 | Achen | E06B 7/082 | 454/195 |
| 5,979,174 | A * | 11/1999 | Kim | F25D 17/065 | 62/404 |
| 5,996,370 | A | 12/1999 | Lee | | |
| 6,112,542 | A * | 9/2000 | Lee | F25D 17/065 | 62/407 |
| 2005/0252232 | A1* | 11/2005 | Lee | F25D 17/065 | 62/340 |
| 2006/0207279 | A1* | 9/2006 | Daddis, Jr. | A47F 3/0408 | 62/255 |
| 2009/0056364 | A1* | 3/2009 | Gorz | F25D 17/065 | 62/407 |
| 2009/0223237 | A1* | 9/2009 | Grassmuck | A47F 3/0447 | 62/255 |
| 2010/0218544 | A1* | 9/2010 | Fotiadis | F25D 17/062 | 62/407 |
| 2010/0251748 | A1 | 10/2010 | Park | | |

* cited by examiner

COOLING DEVICE HAVING AN AIR CHANNEL AND A BAFFLE

BACKGROUND OF THE INVENTION

Field of the Invention

The present invention relates to a cooling device where air is transferred to an evaporator from at least one compartment thereof and which comprises air cooling circulation system.

Description of the Related Art

Cooling devices, particularly domestic refrigerators, function according to the principle that the air, cooled by the evaporator, is circulated inside a compartment formed in a heat insulated body. Air channels, formed on the body and reaching the evaporator, are used for transferring air used for cooling. In order to prevent air from flowing into the air channels, elements, which are in the form of grid, are provided at the channel inlet.

In the patent publication WO2008135434, an embodiment for cool air circulation between the air channel and the storage chambers is disclosed. In an application used in this embodiment, horizontal guiding flaps are adjusted at the inlet openings, and a horizontal air flow to the evaporator channel is facilitated.

SUMMARY OF THE INVENTION

The main object of the present invention is to provide a cooling device which has a cooling space with an air channel and a baffle and wherein damaging risk is reduced against impacts caused by a user or items positioned inside the cooling device.

In order to achieve the abovementioned object, the present invention proposes a cooling device, particularly a domestic refrigerator, comprising a storage space defined by a body and by a door, further comprising an air channel formed within a space at least partially filled with isolation material between an inner wall of the storage space and an outer wall of the cooling device, further comprising at least one opening provided on the inner wall and opened to the air channel, characterized by comprising a baffle positioned completely within the air channel.

The baffle in particular changes the direction of air flow coming from the air channel to the opening. In other words, the baffle in particular changes the flow direction of air passing through the air channel before the air passes through the opening provided on the inner wall.

The abovementioned object can according to the present invention also be solved by a cooling device, particularly a domestic refrigerator comprising a storage space defined by a body and a door, an air channel formed behind an inner wall of the storage space, an opening provided on the inner wall and opened to the air channel, and a baffle which changes the direction of air flow coming from the air channel to the opening. According to this solution the cooling device, in particular a domestic refrigerator, has a baffle positioned completely behind the inner wall and the baffle changes the flow direction of air before air passes through the opening provided on the inner wall. The phrase "behind an inner wall" used with respect to the position of the air channel and the position of the baffle should be understood as when looking from the storage space onto the inner wall.

In particular, the opening of the inner wall can be an air outlet opening of the air channel.

Thus, according to the inventive solutions an inner wall can be provided which has no protrusion, extending into the storage space, at the outlet of the air channel provided behind thereof. By means of this, there is no protrusion which the user or an item, placed into the storage space, may accidentally impacts. Depending on this, it is prevented that the user harms himself and/or the cooling device, particularly the baffle, is protected against damages. In addition to these, it is achieved that the minimal blockage occurs when air flows parallel to the inner wall in the storage space, resulting in a homogeneous and linear air flow. This may have a favorable effect on the cooling performance. Moreover, an inner wall can be obtained having no protrusion thereon and which is visually flat. This may affect the user satisfaction in a favorable manner. As another advantage, access to the baffle, which is hidden behind the inner wall, from outside (by the user or by an incompetent person, etc.) can be prevented.

In a possible embodiment of the present invention, the inner wall comprises several openings, wherein two neighboring openings are separated from each other by a bar. The bar, which can be in the form of a web or bridge or crosspiece, can be an integral part of the inner wall. In a view normal to a plane including the opening the bar can cover a part of the baffle, such that this part is not visible along that view.

In a possible embodiment of the present invention, the inner wall comprises pluralities of linear openings which are parallel with respect to each other. Thus, the opening area, which permits the required air output, can be obtained, and at the same time, narrow openings, which will prevent access to the air channel from outside, can be provided.

In a possible embodiment of the present invention, pluralities of openings of the inner wall are in grid form. Thus, the advantages of pluralities of openings can be obtained, and at the same time, an inner wall, which has high resistance in the opening region, can be obtained. For instance, the opening can be obtained by means of strips which are parallel with respect to each other. In another embodiment, in addition to parallel strips, one or more than one vertical strip can be provided which intersect(s) these strips at a specific angle, particularly at an orthogonal or substantially orthogonal angle.

The air channel can extend in direction from a rear wall of the air channel towards the storage space up to an edge section surrounding the opening on a surface of the inner wall facing the storage space. With respect to the inventive solution that the baffle is positioned completely within the air channel, thus the baffle can extend into the opening. In particular, the baffle can extend into the opening up to the edge section surrounding the opening on the surface of the inner wall facing the storage space. In that case a part of the baffle is flush with a surface area surrounding the edge section. For example, the baffle can have a frame which extends into the opening up to said edge section and which abuts walls of the openings. This has the advantage of a precise positioning of the baffle with respect to the opening. In a possible embodiment of the present invention, however, the baffle is positioned outside the at least one opening. That is, the baffle does not extend into opening.

In a possible embodiment of the present invention, the baffle comprises a support element, in particular a support wall, facing a rear surface or rear side of the inner wall. Thus, the inner wall can be supported by the baffle although there is a clearance or hollow space (namely the air channel outlet) behind the inner wall. By means of this, the deformation of the inner wall as a result of a force or impact applied onto the inner wall can substantially be prevented. There can either be a gap between the support element or support wall and the inner wall; alternatively the support element or support wall contacts the inner wall. In case of a gap the deformation is substantially limited to the thickness of the gap. In case of a contact between the support element or support wall and the inner wall it is possible to virtually completely eliminate any deformation of the inner wall. In case the inner wall comprises several openings wherein two neighboring openings are separated from each other by a bar, the support element or support wall can face, in particular contact, a surface section of the rear surface of the inner wall positioned on the bar. In this case the bar can be selectively reinforced by the baffle. The support element or support wall can be of such form and size, that more than half of the surface section of the rear surface of the inner wall positioned on the bar is contacted, preferably more than 75 percent of that surface, more preferably more than 90 percent of that surface. In order not to block any of the openings by the baffle, the support element or support wall can be of such form or size that less than 100 percent of the surface section of the rear surface of the inner wall positioned on the bar is contacted by the baffle.

In case more than one bar is present, there can be as many support elements or support walls as there are bars and each support element or support wall can face, in particular contact, an area of the rear surface of the inner wall positioned on one of the bars.

In a possible embodiment of the present invention, the baffle is fixed to the inner wall. It is possible that the baffle is fixed via adhesive means, e.g. liquid adhesive or double sided adhesive tape, to the inner wall. An adhesive connection has the advantage that this connection can also serve the purpose of a sealing at the connection between the baffle and the inner wall.

In a possible embodiment of the present invention, the baffle comprises an adhesion face formed on the baffle and fixed to a rear surface or rear side of the inner wall. Thus, the related region of the inner wall, having a space behind, can be fixed. In the opposite case, the inner wall can be deformed in a manner forming a protrusion, which is in embossment form, in the related region. In case the baffle comprises a support element or support wall the adhesion face can be formed thereon.

In a possible embodiment of the present invention, the baffle comprises a support element contacting a wall segment of the air channel. The support element prevents unwanted displacement of the baffle in a direction normal to said wall segment. For example, the support element of the baffle can contact a wall segment of a rear wall of the air channel, lying opposite the opening of the inner wall, thus preventing the baffle from being pushed or deflected towards that rear wall. In case the baffle also contacts the inner wall, in particular a bar between two openings on the inner wall, this allows a very robust support of the inner wall, in particular the bar.

In a possible embodiment of the present invention, the baffle comprises a connection element for fixing the baffle to the air channel. Additionally or alternatively, in a possible embodiment of the present invention, the baffle comprises a connection element which fixes the baffle in a manner corresponding to the opening provided on the inner wall. Thus, the baffle can be fixed at its position and maintain its position during production. Particularly, in cooling devices like domestic refrigerators where the walls of the storage space are insulated, the baffle can be fixed at the required position during application of the insulation materials used during production of the walls. For instance, the baffle can be connected to the air channel and fixed. The connection element can be configured to provide a form-fit. In case the connection element is configured for fixing the baffle to the air channel, a corresponding connection element in the air channel, e.g. on a wall segment thereof, is provided. In that case the baffle can be fixed to the air channel only by form-fit, that is no gluing or welding is necessary. In particular, the baffle can be fixed to the air channel by hand.

In a possible embodiment of the present invention, the connection element is a tab or embodied by a wall segment of the baffle or formed on a wall segment of the baffle. Thus, a connection element can be provided which is easy to produce. For instance, it can be obtained by means of the minimum number of production steps such that the tabs are one piece with the remaining section of the baffle. For instance, the baffle can be obtained together with connection elements in single-piece form by means of plastic injection.

In case the connection element is embodied by a wall segment or formed on a wall segment of the baffle, the wall segment of the baffle can be sandwiched between two ribs extending from a wall segment of the air channel. In particular, the wall segment of the baffle can extend essentially normal to a rear wall of the air channel and said two ribs can extend essentially normal from said rear wall of the air channel. This allows a simple fixation of the baffle at the air channel, simply by pushing the baffle towards the rear wall of the air channel. In any case, said wall segment of the baffle can comprise a locking tab, e.g. protruding from a side wall of the wall segment, which can engage a locking recess formed in one of the ribs. In particular, there can be at least on locking tab protruding from each of the two side walls of the wall segment in which case each rib comprises at least one corresponding locking recess.

In case the connection element is embodied by a wall segment or formed on a wall segment of the baffle which is sandwiched between two ribs extending from a wall segment of the air channel, the wall segment of the baffle and the ribs can comprise lead-in chamfers. This further simplifies the assembly, since the lead-in chamfers will ensure that the baffle will inevitably be guided into the desired position once it is pushed, e.g. simply by hand, into the air channel.

In a possible embodiment of the present invention, the connection element is formed on a connection wall of the baffle and engages with a connection element formed on a side wall of the air channel. In particular, the baffle can comprise two connection walls on opposite end sections of the baffle, wherein on each connection wall a connection element is formed which engages with one of two side walls of the air channel. In this way the baffle can be restrained or clamped between two opposing side walls of the air channel. Alternatively or in addition, in a possible embodiment of the present invention, the baffle comprises a slit provided on a connection wall, where the connection element is provided, and on a side of the connection element. Thus, for providing bending of the connection element, the connection thereof to the connection wall can be weakened. This can provide an easy-to-use connection element. For instance, by means of the bendable connection element, the baffle can be connected to its place by means of a single pushing movement.

In a possible embodiment of the present invention, the baffle has a flap which guides the air flow. Thus, the baffle can structurally guide air not as a whole, but by means of the flap or flaps provided thereon. By means of this, instead of a big and bulky baffle, a baffle which occupies relatively smaller volume can be obtained. In case the thicknesses of the walls of the storage space are small, there may be the need for a compact baffle. In a possible embodiment where the flap is not integrated with the remaining section of the baffle, the guiding angle for the air can be adjusted. Thus, the need for producing different baffles for cooling devices needing different angled guidance can be eliminated. This may favorably affect the production costs. For reasons of simplification of the manufacturing the flap can be an integral part of the baffle.

In a possible embodiment of the present invention, the baffle comprises a reinforcing wall connected to the flap and which intersects the flap. Thus, the flap, which can be or is generally in the form of a long and thin plate, may be supported for preventing bending or deformation. Moreover, the flap can be kept fixed and it can guide air flow at a specific angle.

In a possible embodiment of the present invention, the inner wall is made of metal. Thus, the inner wall can be resistant, e.g. having a high stiffness, and in connection to this, the opening region can be resistant. In the embodiment comprising pluralities of openings, the resistance of the strips or bars provided between the openings can be high since the wall is of metal and thus since the strips are metal. In particular, the openings can be punched.

In a possible embodiment of the present invention, the inner wall is the inner wall of the door. Thus, since the baffle is particularly used at the door, the risk of damage to the baffle by an impact of an item placed at the door shelf can be prevented. Thus, particularly on the inner wall, the intermediate regions or bars, which are formed by pluralities of openings and which are in strip form, can be supported.

In a possible embodiment of the present invention, the baffle is formed integrally, that is formed in one piece. The baffle can be made of plastic, in particular made as injection molding part.

In a possible embodiment of the present invention, the flap and the support wall are integrated. Thus, both the resistance of the flap and resistance of the support wall can be high. Particularly, since the flap and the support wall, formed with a specific angle in between with respect to each other, are integrated so that these components and, in general, the baffle are strengthened. Particularly, the flap and the support wall, which are integrated with the remaining sections of the baffle, may ensure that the baffle can be manufactured easily with reduced number of production steps but with a high strength. Accordingly, a baffle, having long lifetime, can be provided.

In a possible embodiment of the present invention, there is an angle, which is smaller than 90 degrees, between a front face of the flap, facing a rear side or rear surface of the inner wall, and the rear side or rear surface of the inner wall. Thus, the air, coming from the air channel to the rear side or rear surface of the inner wall with an orthogonal or substantially orthogonal angle, can be guided to a different direction. Moreover, at specific angles, the inner section of the air channel can be prevented from being viewed through the openings provided on the inner wall and/or the insertion of an external object into the air channel by incompetent persons can be prevented.

In a possible embodiment of the present invention, the baffle is a grid. Thus, a resistant baffle can be obtained in connection to the grid form.

DESCRIPTION OF THE INVENTION

Figure 1:
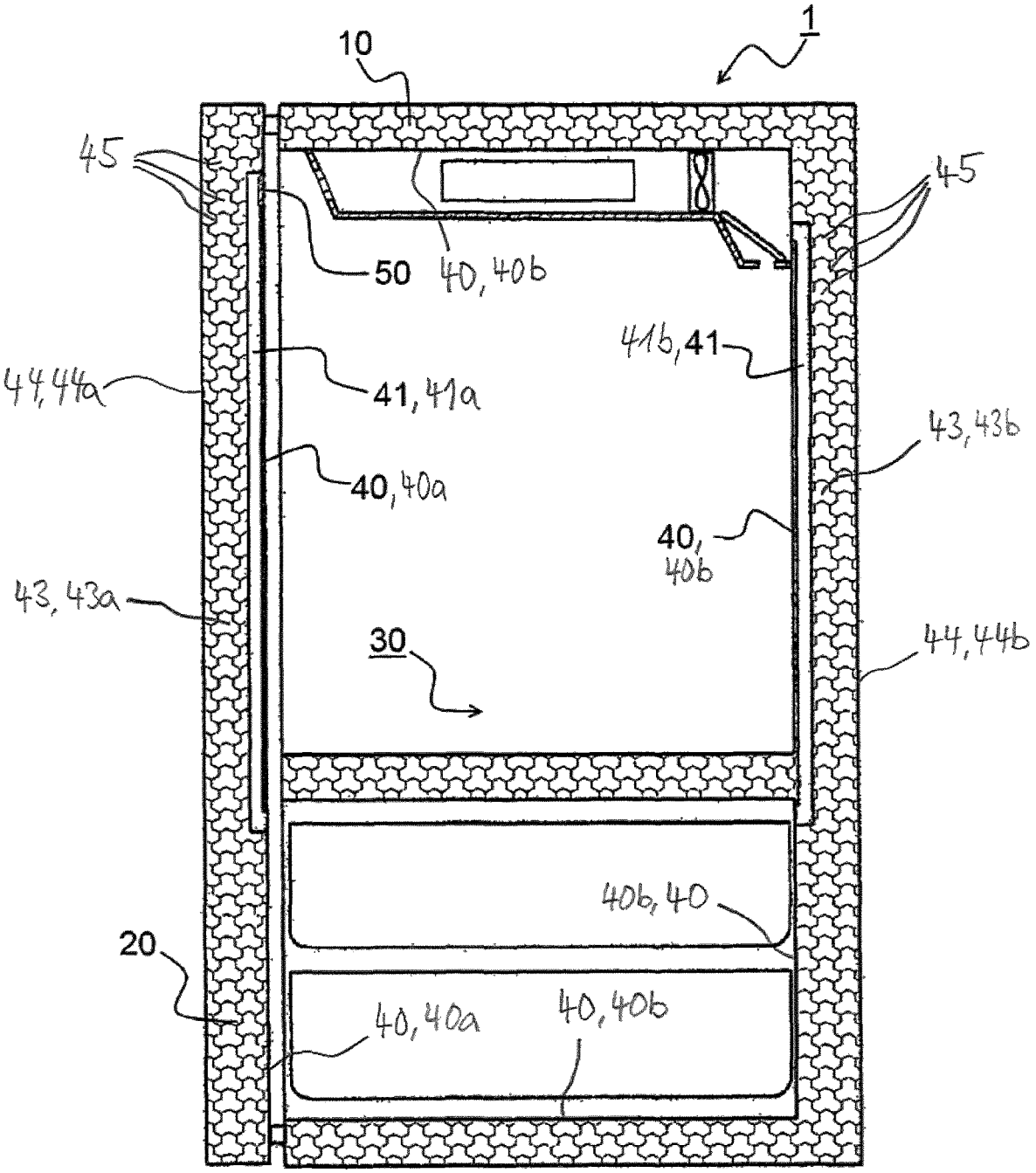
FIG. 1 is the lateral schematic cross sectional view of a domestic refrigerator where a representative embodiment of the subject matter baffle is adapted.

In FIG. 1, a domestic refrigerator is illustrated. The heat insulated body 10 is structurally separated into pluralities of cooling chambers by means of departmentalization. A door 20 is covered in an openable manner onto the open face of the body 10. The storage space 30, obtained by means of departmentalization inside the body 10, is encircled by the inner walls 40. An air channel 41 is adjusted on the inner wall 40. The air channel 41 can extend from the evaporator to the storage space 30 or it can be provided on the door 20 for transferring the cool air cycle to different sections in the storage space 30. The air channel 41 can be formed in a pipe, or it can be embodied by covering the upper section of a housing formed directly on the inner wall 40.

In particular, there exists an air channel 41*a* within the door 20 as well as an air channel 41*b* within the body 10. Each air channel 41*a*, 41*b* is formed within a space 43 which is at least partially filled with isolation material 44. The space 43 within the door 20, that is the space 43*a*, is formed between an inner wall 40, namely an inner wall 40*a* of the door 20, and an outer wall 44 of the cooling device 1, namely an outer wall 44*a* of the door 20. The space 43 within the body 10, that is the space 43*b*, is formed between an inner wall 40, namely an inner wall 40*b* of the body 10, and an outer wall 44 of the cooling device 1, namely an outer wall 44*b* of the body 10.

Figure 2:
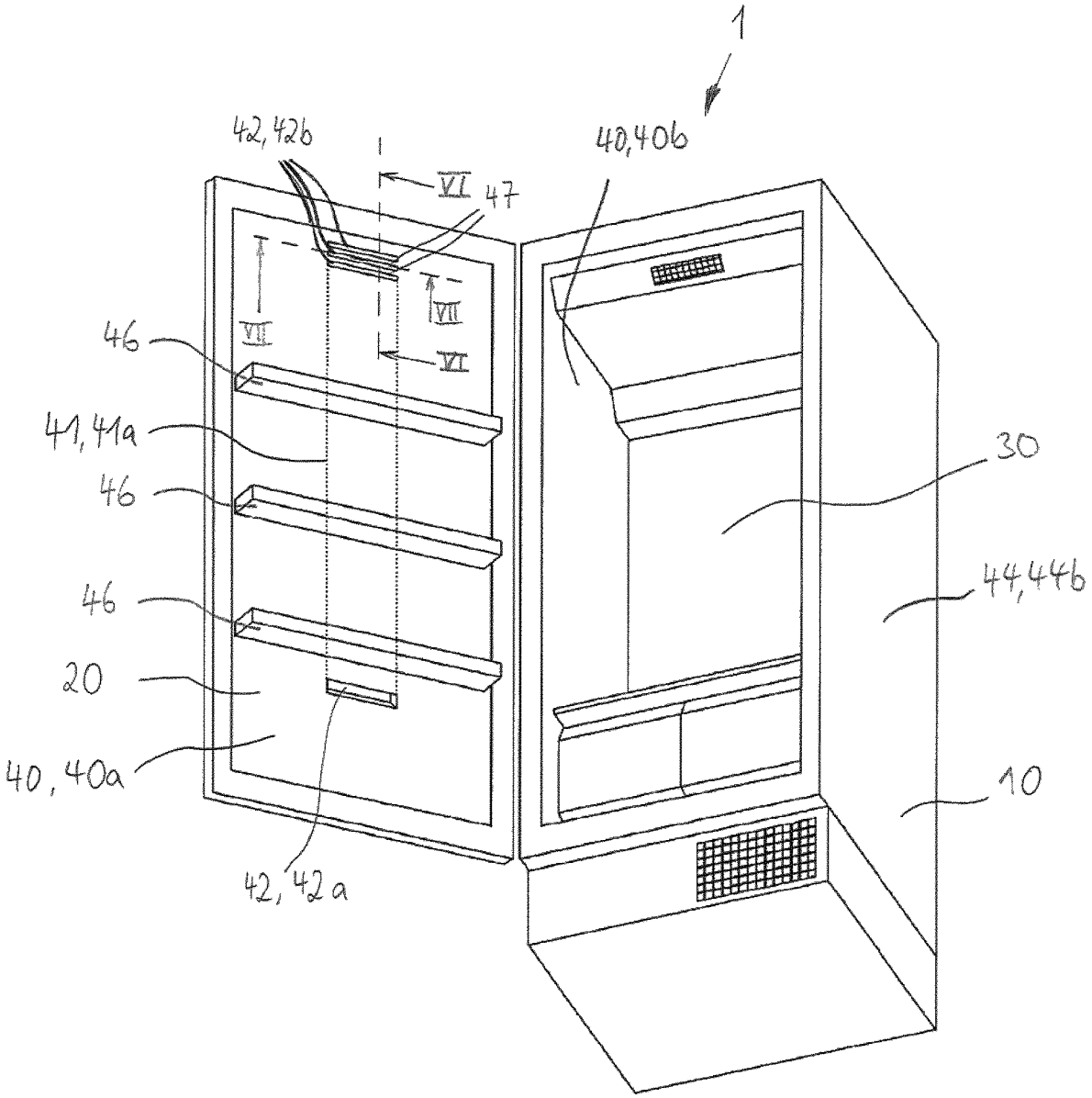
FIG. 2 is a schematic perspective view of a cooling device of a representative embodiment of the present invention where the door is open.

FIG. 2 is a schematic perspective view of a cooling device 1 of a representative embodiment of the present invention where the door 20 is open. For illustration purposes only an air channel 41 within the door 30, that is the air channel 41*a*, is depicted by dotted lines. This air channel 41*a* is positioned within the space 43*a* in the door; that is the air channel 41*a* is covered by the inner wall 40*a* when looking in a frontal view at the inner wall 40*a*. On the inner wall 41*a* are door bins 46 installed.

There are several openings 42, 42*a*, 42*b* provided on the inner wall 40*a*. In particular there is one opening 42*a* located below the lowest door bin 46 which serves as air inlet opening of the air channel 41*a*. Above the highest door bin 46 are three openings 42*b* which serve as air outlet openings of the air channel 41*a*. All openings 42*a*, 42*b* are of rectangular shape, moreover all openings 42*a*, 42*b* are in form of slits. The openings 42*a*, 42*b* are produced by punching them into the inner wall 40*a* which is made of metal. The openings 42*b* are formed as a group of openings 42*b*, that is, neighboring openings 42*b* are distanced from each other by a bar 47 which has also a rectangular shape in a frontal view onto the openings 42*b* and the thickness of the bars 47 in that view corresponds essentially to the thickness of the openings 42*b*.

In operation of the cooling device 1 air is blown or drawn through the air channel 41*a* by entering the air inlet opening 42*a*, flowing upwards through the air channel 41*a* and leaving the air outlet opening 42*b*. There is no fan within the air channel 42*b*.

A baffle 50 which is not visible in FIG. 2 is located within the air channel 41*a*. In a frontal view onto the openings 42*b*, that is a view normal to a plane containing the openings 42*b*, the baffle 50 is located essentially completely behind a rectangular section of the inner wall 40*a* containing the openings 42*b*. The baffle 50 changes the direction of the air flow coming from the air channel 41*a* to the openings 42*b* and changes the flow direction of the air passing through the air channel 41*a* before the air passes through the openings 42*b* provided on the inner wall 40*a*.

Figure 3:
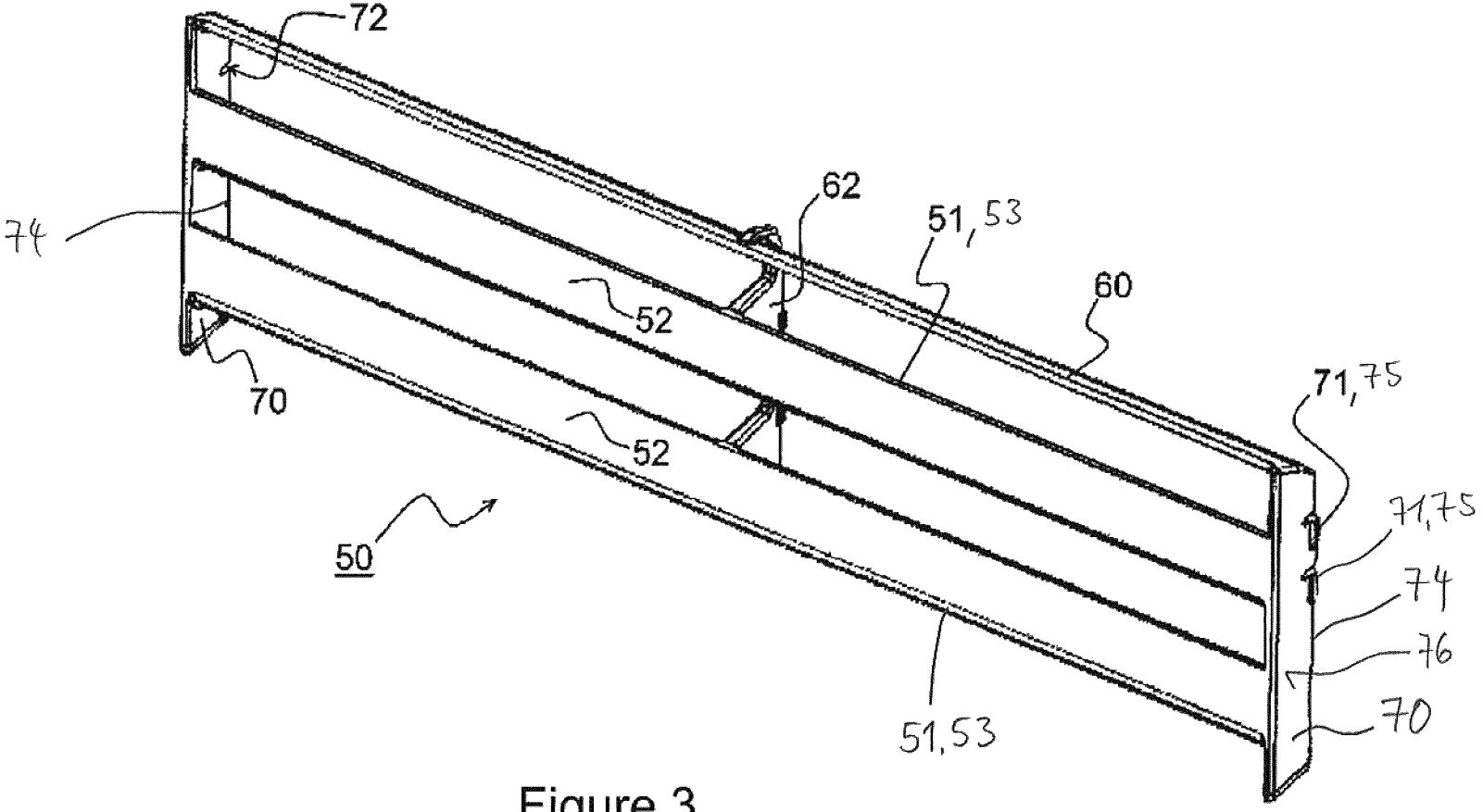
FIG. 3 is the perspective view of a representative embodiment of the subject matter baffle.

In FIG. 3, a baffle 50 is illustrated which is configured for being fixed inside an air channel 41, 41*a*, 41*b* of the cooling device according to FIGS. 1 and 2. The baffle 50 is in the form of a grid created by means of flat rods, which are spaced apart from each other and which are in a planar structure, from an outer wall thereof with respect to the position where the baffle 50 is placed to the air channel 41. A support element 53 in form of a support wall 51, having an adhesion face 52 which is in transversely or horizontally extending strip form, is joined by means of two connection walls 70 bent vertically onto the adhesion face 52 at both end sections of the support wall 51. In particular the baffle 50 has two support elements 53, both in form of support walls 51 and both having an adhesion face 52.

In an assembled state of the cooling device 1, e.g. when the baffle 50 is positioned within the air channel 41*a* the adhesion faces 52 are fixed to a rear surface 73 (depicted in FIG. 4) of the inner wall 40*a* of the door 30. Thus, no protrusion is formed from the air channel 41*a* extending beyond the inner wall 40*a*.

The connection wall 70 is a flat wall where the support wall 51 is bent in an orthogonal angled manner with respect to the adhesion face 52. Connection elements 71, which are in form of tabs 75, are provided on each of the connection walls 70. There are slits 72 extending from the sides of the connection elements 71 that is the slits 72 extend from edges 74 of the connection elements 71 into the connection element 71. In this way the connection elements 71, in particular the tabs 75, can be elastically deflected and provide means for a form fit connection between the baffle 50 and a wall of the air channel 41*a*.

The connection elements 71, i.e. the tabs 75, extend essentially orthogonal out of an outwardly oriented surface 76 of the connection walls 70. Thus the connection elements 71 are suited to be connected to or engaged with corresponding connection elements on side walls of the air channel 41*a*.

Thus, the baffle 50 is seated to corresponding sections at the air channel 41. The baffle 50 is supported inside the air channel 41 with the help of the connection walls 70 extending mutually only on the lateral sections. The connection wall 70 has no extension encircling at the top or at the bottom. Therefore, the bottom edge of the baffle 50 has an angled flap 60.

In order to prevent deflection of the extended support walls 51 in the intermediate section, a vertical reinforcing wall 62 intersects with support walls 51 which extend transversely. The reinforcing wall 62 is positioned in a manner reducing resistance in air flow direction such that the thin section of the reinforcing wall 62 is orthogonal with respect to the flap 60 plane.

The reinforcing wall 62 comprises further connection elements 71, again in form of tabs 75. These connection elements 71 can engage with corresponding connection elements formed on e.g. a rear wall of the air channel 41*a*.

The reinforcing wall 62 as well as the two connection walls 70 act as support elements 77, that is these elements contact in the assembled state wall segments of the air channel 41*a*. This leads to a robust support of the baffle 50, in particular this further prevents any undesired deformation of the inner wall 40*a* in an area surrounding the openings 42*b*, since the inner wall 40*a* is first of all supported by the baffle 50 and the baffle 50 in turn is supported by the wall segments of the air channel 41*a*.

Figure 5:
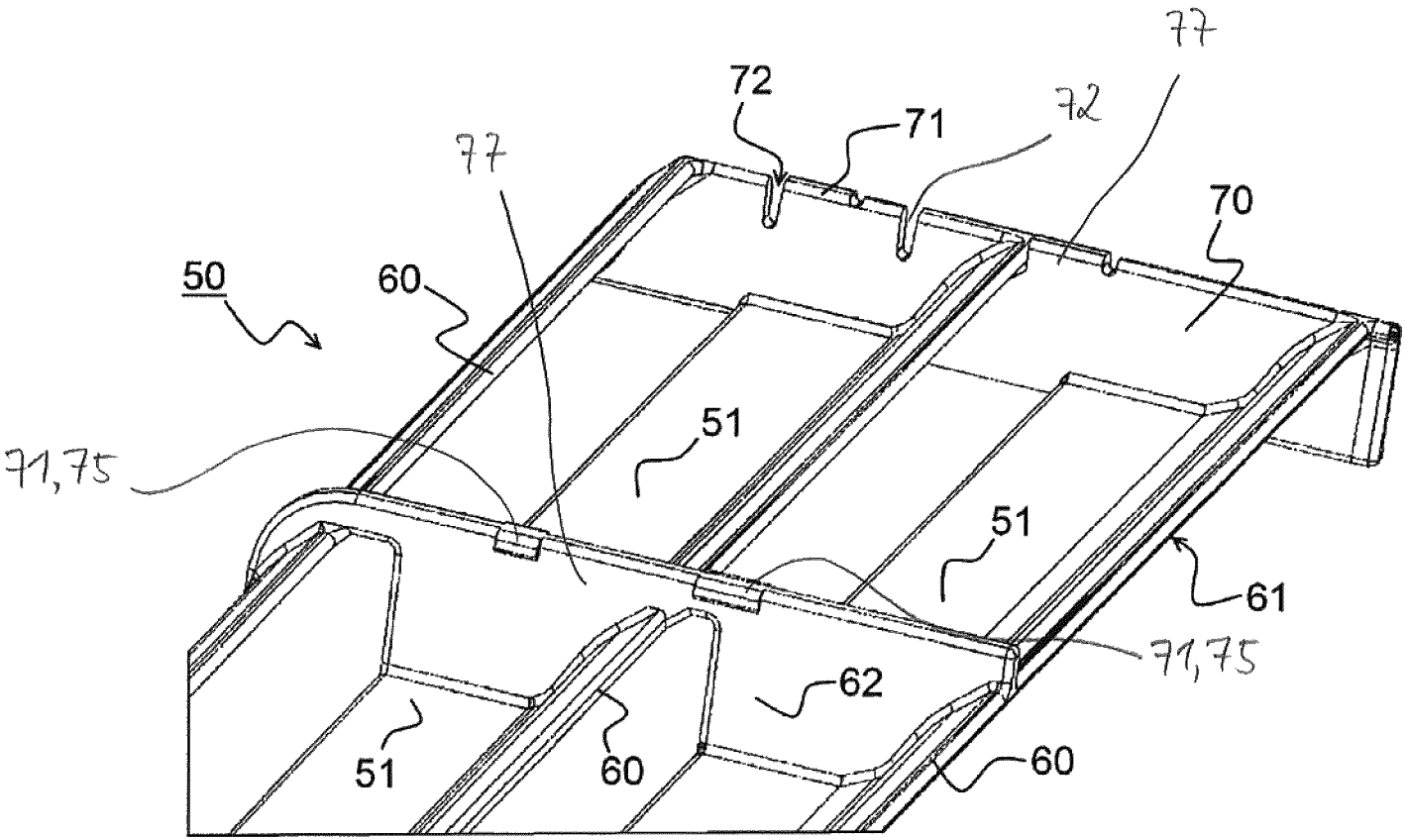
FIG. 5 is the rear perspective view of a section of a representative embodiment of the subject matter baffle, that is the embodiment illustrated in FIG. 3.

As can be seen in FIG. 5, the support wall 51 is bent in a V-like structure with wide angle, and thus, the flaps 60 are formed. The opening between the support walls 51 is hidden when viewed frontally, and the direction of the entering air is changed at an amount equal to the bending angle (a).

Figure 6:
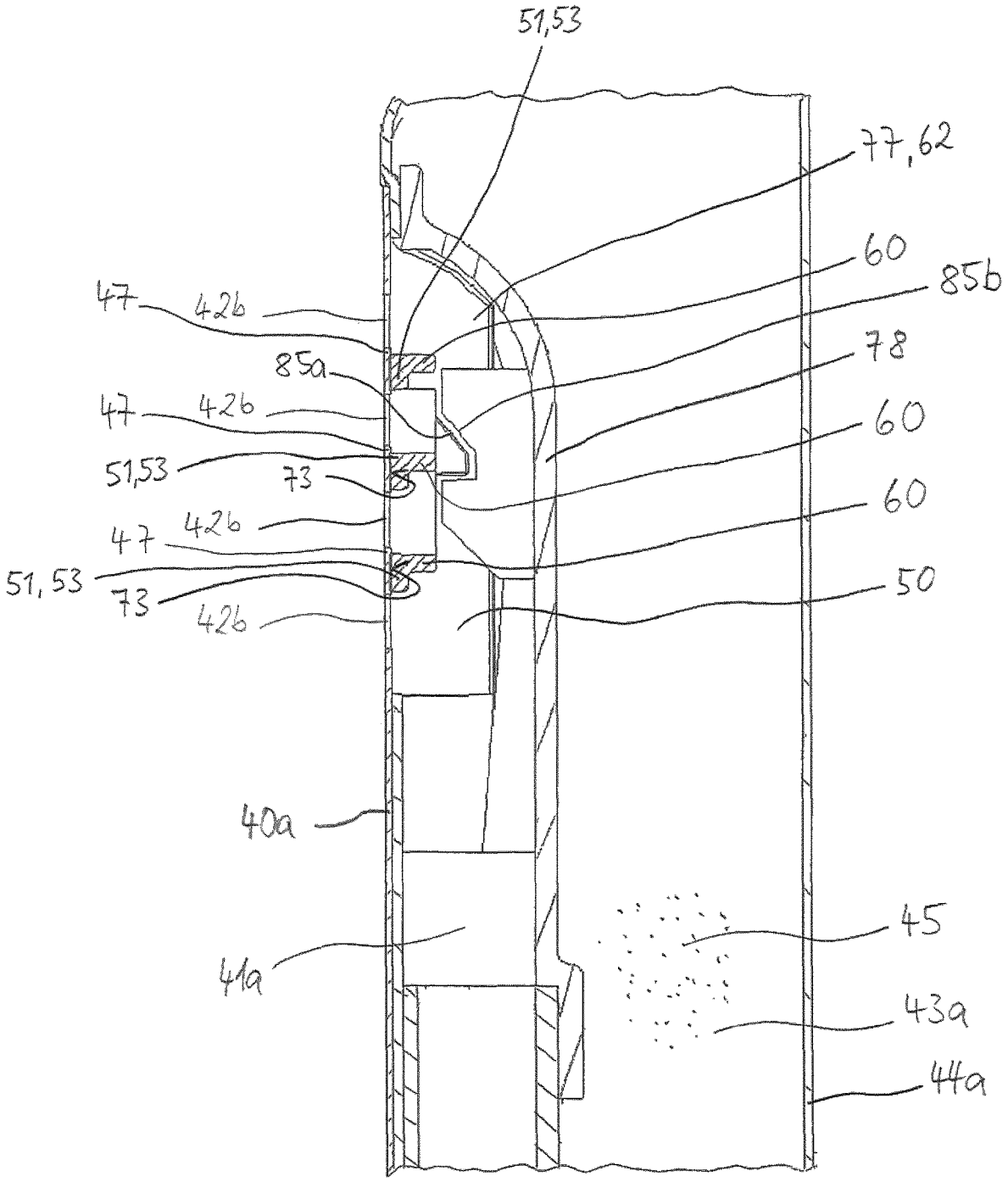
FIG. 6 is a cross-sectional view along section VI-VI in FIG. 2 of an area of a cooling device according to a second representative embodiment of the invention.

FIG. 6 is a cross-sectional view along section VI-VI in FIG. 2 of an area of a cooling device according to a second representative embodiment of the invention.

Figure 4:
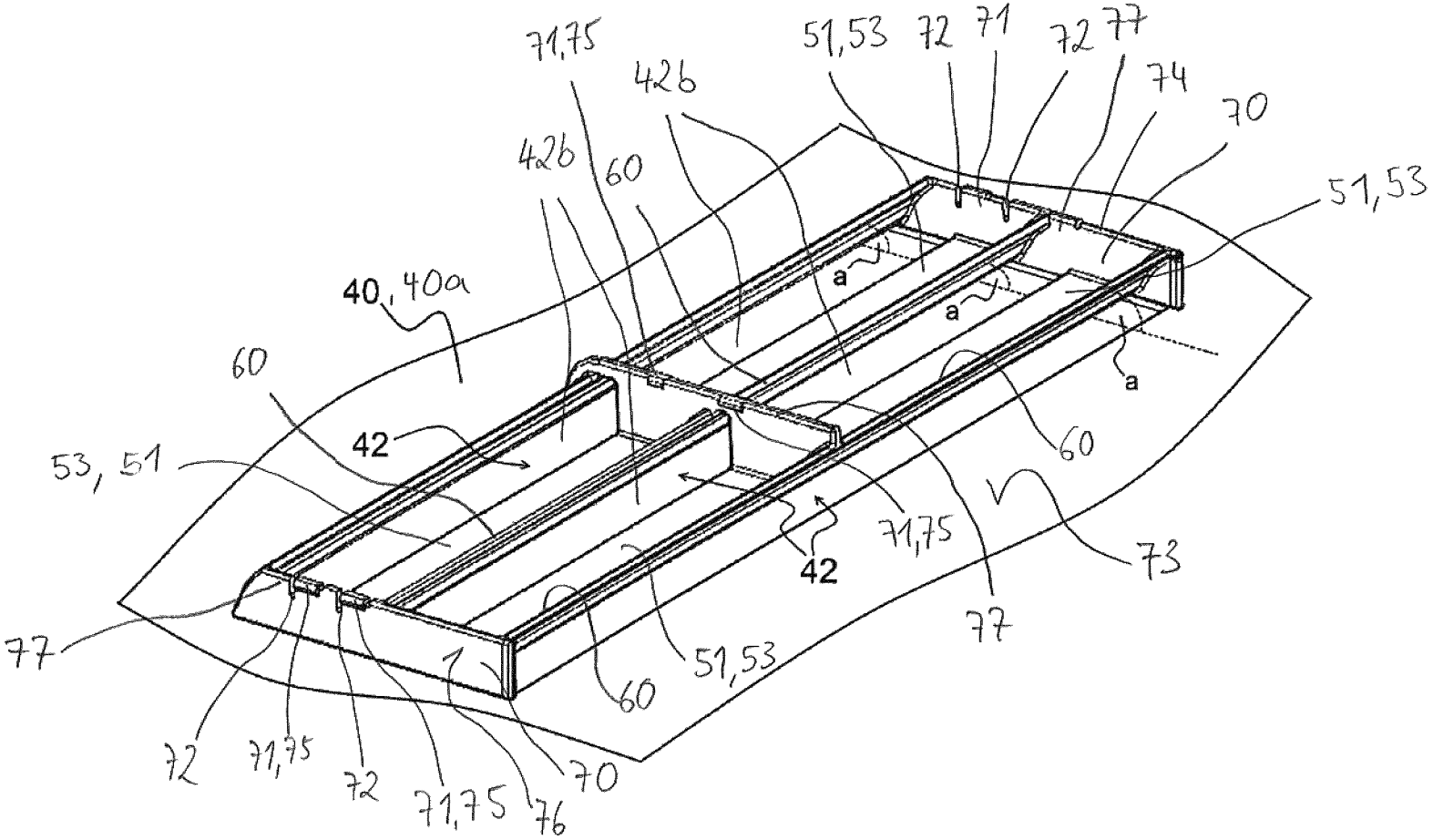
FIG. 4 is the front perspective assembly view of the embodiment illustrated in FIG. 3.

In difference to the embodiment according to the FIGS. 3-5 the baffle 50 comprises flaps 60 which are orthogonally oriented with respect to the support wall 51. Furthermore, rather than having three air outlet openings 42*b* there exist four air outlet openings 42*b*. Consequently, there are three bars 47 formed by the inner wall 40*a* and separating the openings 42*b*.

The baffle 50 comprises support element 77 formed by the reinforcing wall 62 contacting a wall segment, namely a rear wall 78, of the air channel 41*a*.

Figure 7:
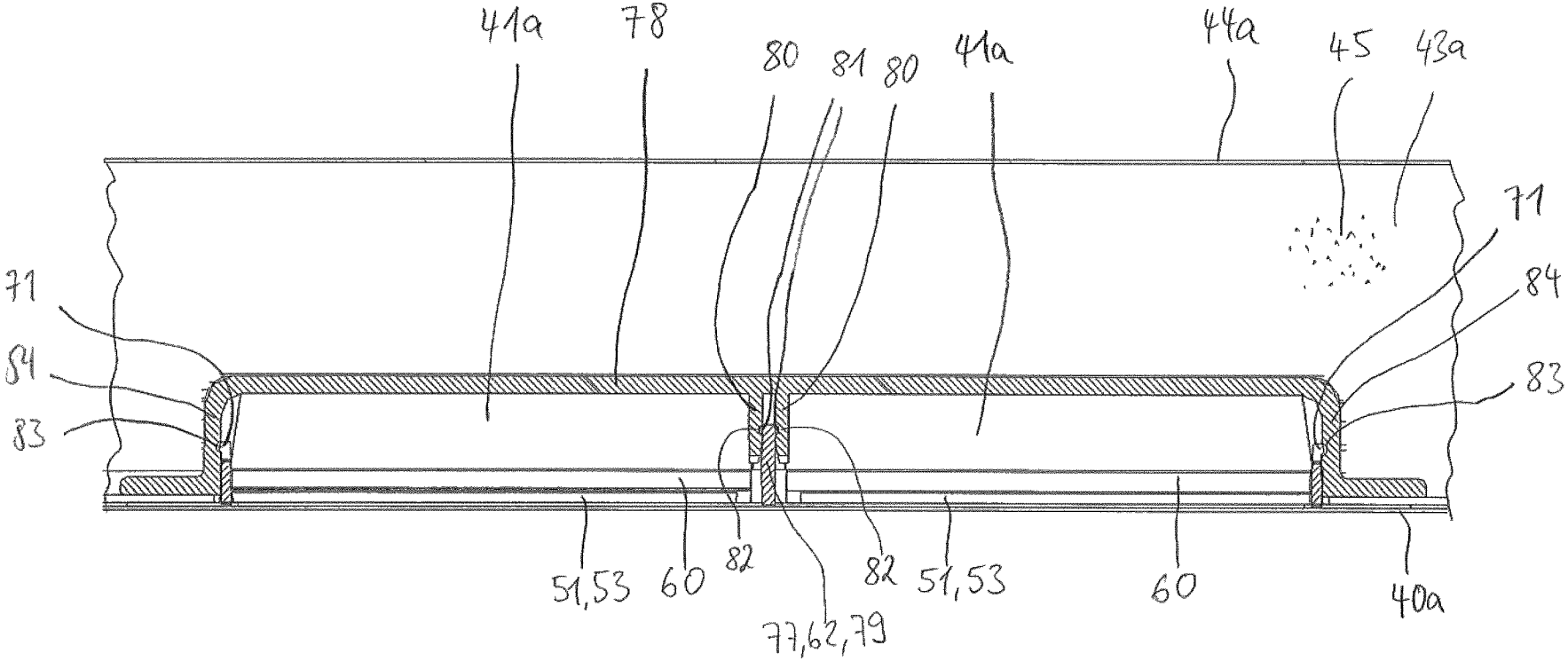
FIG. 7 is a cross-sectional view along section VII-VII in FIG. 2 of an area of a cooling device according to the second representative embodiment of the invention.

As shown in FIG. 7, a connection element 71 is embodied by a wall segment 79 of the baffle 50, in particular said wall segment 79 corresponds in this embodiment to the reinforcing wall 62. The wall segment 79 is sandwiched between two ribs 80 extending from a wall segment of the air channel 41*a*, in particular from the rear wall 78. The wall segment 79 together with the ribs 80 form a press-fit connection and a form-fit connection between the baffle 50 and the wall segment of the air channel 41*a*. The wall segment 79 further contains two locking tabs 81, protruding from side surfaces and engaging locking recesses 82 formed on the ribs 80.

On both connection walls 70 are further connection elements 71 in form of flexible tabs which engage with connection elements 83, namely recesses, of side walls 84 of the air channel 41*a*.

Figure 8:
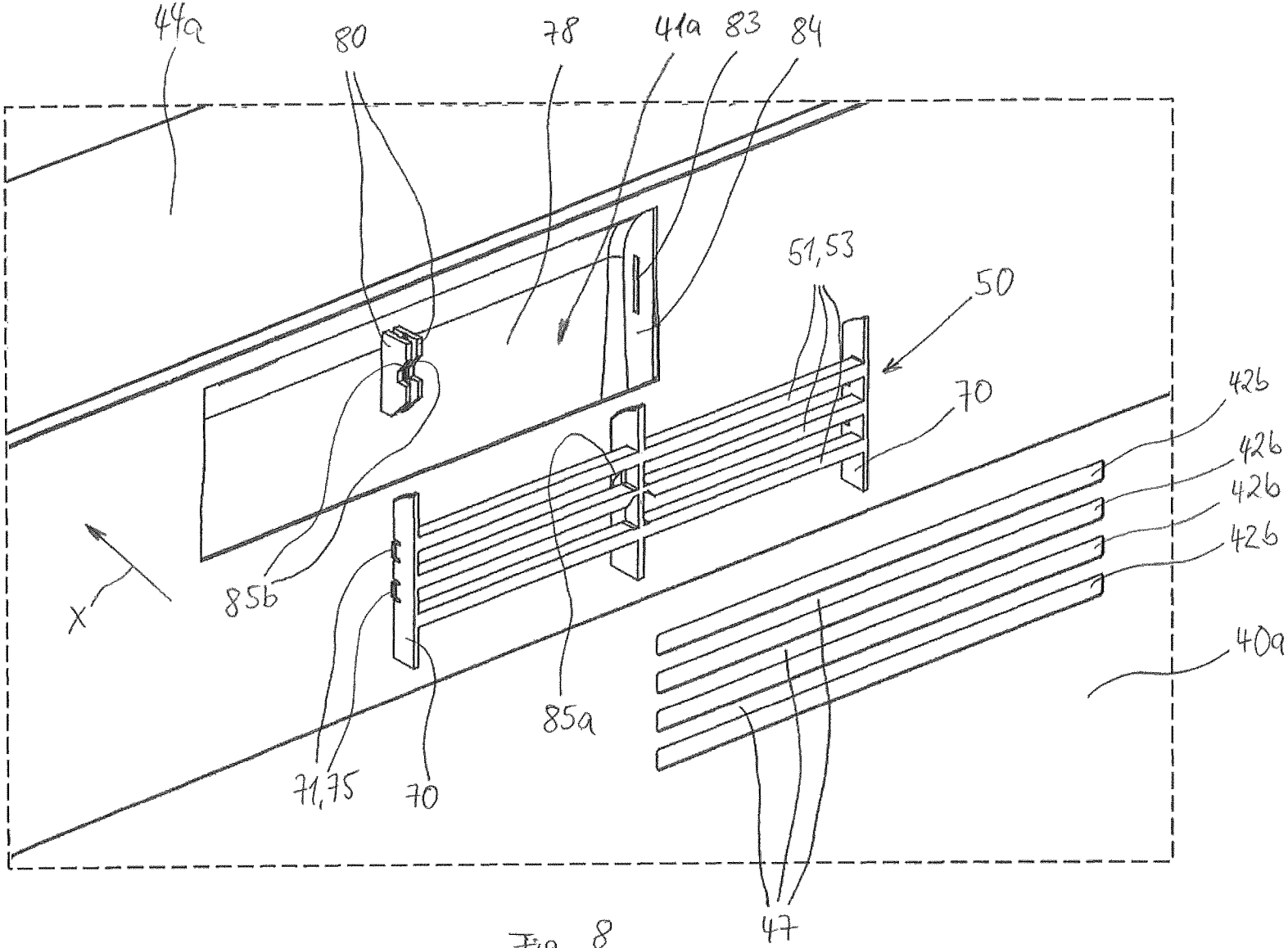
FIG. 8 is a detail of a cooling device according to the second representative embodiment of the invention in a partly assembled state.

As depicted in FIGS. 6 and 8 the wall segment 79 of the baffle 50 and the two ribs 80 comprise lead-in chamfers 85*a* and 85*b*, which enable a simplified assembly of the baffle 50 and ensure a correct position of the assembled baffle 50.

FIG. 8 is a detail of a cooling device according to the second representative embodiment of the invention in a partly assembled state. In particular, the baffle 50 has not yet been fixed to the air channel 41*a*. Rather, the baffle 50 needs to be pushed, e.g. by hand, along direction X into the air channel 50 such that the lead-in chamfers 85*a* and 85*b* engage with each other and correctly align the baffle 50. As soon as the baffle 50 is correctly aligned and further pushed along direction X the connection elements 71 of the connection walls 70 engage with the connection elements 83 of the side wall 84 and furthermore the wall segment 79 of the baffle 50 will be sandwiched between the two ribs 80 which also leads to the locking tabs 81 to enter the locking recesses 82.

Once the baffle 50 has been fixed to the air channel 41*a*, the inner wall 40*a* can be attached, e.g. by adhesive means. At this stage the hollow space 43*a* can be filled with isolation material.

REFERENCE NUMBERS

1. Cooling device
10. Body
20. Door
30. Storage space
40. Inner wall
40*a* Inner wall (door)
40*b* Inner wall (body)
41. Air channel
41*a* Air channel (in door)
41*b* Air channel (in body)
42. Opening
42*a* Opening
42*b* Opening
43. Space
43*a* Space (in door)
43*b* Space (in body)
44. Outer wall
44*a* outer wall (door)
44*b* outer wall (body)
45. Isolation material
46. Door bin
47. Bar
50. Baffle
51. Support wall
52. Adhesion face
53. Support element
60. Flap
61. Front face
62. Reinforcing wall
70. Connection wall
71. Connection element
72. Slit
73. Rear surface
74. Edge
75. Tab
76. Surface
77. Support element
78. Rear wall
79. Wall segment
80. Rib
81. Locking tab
82. Locking recess
83. Connection element
84. Side wall
85*a* Lead-in chamfer
85*b* Lead-in chamfer
a. Angle

The invention claimed is:

1. A cooling device or domestic refrigerator, comprising:
a body having an outer wall;
a door;
said body and said door defining a storage space therebetween having an inner wall;
said inner wall of said storage space and said outer wall of said body defining an insulating space therebetween being at least partially filled with insulating material;
an air channel formed within said insulating space, said air channel having a longitudinal extent;
said inner wall of said storage space having a plurality of openings formed therein being open to said air channel;
a bar separating two neighboring openings from each other and
a baffle disposed completely within said air channel, said baffle including a connector fixing said baffle to said air channel, said baffle having a length being transverse to said longitudinal extent of said air channel, and said baffle having a flap guiding an air flow, said flap being transverse to said longitudinal extent;
said air channel having a wall segment being a rear wall lying opposite the openings of the inner wall, and said baffle including a support element contacting said rear wall.

2. The cooling device according to claim 1, wherein said baffle is disposed outside said at least one opening.

3. The cooling device according to claim 1, wherein said inner wall of said storage space has a rear surface, and said baffle includes a further support element facing said rear surface of said inner wall.

4. The cooling device according to claim 3, wherein said further support element is a support wall.

5. The cooling device according to claim 3, wherein said rear surface of said inner wall of said storage space has a surface section disposed on said bar, and said further support element faces said surface section.

6. The cooling device according to claim 3, wherein said baffle includes an adhesion face formed on said baffle and fixed to said rear surface of said inner wall of said storage space.

7. The cooling device according to claim 1, wherein:
said air channel has two ribs extending from said wall segment;
said support element being sandwiched between said two ribs.

8. The cooling device according to claim 7, wherein said support element of said baffle and said ribs have lead-in chamfers.

9. The cooling device according to claim 1, wherein:
said air channel has a side wall and a connector formed on said side wall;
said baffle has a connection wall; and
said connector of said baffle is formed on said connection wall of said baffle and engages with said connector formed on said side wall of said air channel.

10. The cooling device according to claim 1, wherein said baffle has a flap guiding an air flow.

11. The cooling device according to claim 10, wherein said baffle includes a reinforcing wall connected to said flap and intersecting said flap.

12. The cooling device according to claim 1, wherein said inner wall of said storage space is made of metal.

13. The cooling device according to claim 1, wherein said inner wall of said storage space is an inner wall of said door.

14. The cooling device according to claim 1, wherein said baffle is a one piece construction.

15. A cooling device or domestic refrigerator, comprising:
a body having an outer wall;
a door;
said body and said door defining a storage space therebetween having an inner wall;
said inner wall of said storage space and said outer wall of said body defining an insulating space therebetween being at least partially filled with insulating material;
an air channel formed within said insulating space;
said inner wall of said storage space having a plurality of openings formed therein being open to said air channel;
a bar separating two neighboring openings from each other and a baffle disposed completely within said air channel, said baffle having a length being transverse to a longitudinal extent of said air channel, and said baffle including a connector fixing said baffle to said air channel, said connector being a plurality of connectors and said baffle including opposing connection walls having respective baffle connectors and said air channel having opposing side walls, said respective baffle connectors each engaging a respective sidewall;

said air channel having wall segment being a rear wall lying opposite the openings of the inner wall, and said baffle including a support element contacting said rear wall.

* * * * *